US008193718B2

(12) United States Patent
Cho et al.

(10) Patent No.: US 8,193,718 B2
(45) **Date of Patent: *Jun. 5, 2012**

(54) DIAGNOSIS CIRCUIT APPARATUS AND LAMP BALLAST CIRCUIT USING THE SAME

(75) Inventors: Gye-Hyun Cho, Bucheon (KR); Young-Sik Lee, Seoul (KR)

(73) Assignee: Fairchild Korea Semiconductor, Ltd., Bucheon (KR)

( * ) Notice: Subject to any disclaimer, the term of this patent is extended or adjusted under 35 U.S.C. 154(b) by 834 days.

This patent is subject to a terminal disclaimer.

(21) Appl. No.: 12/217,375

(22) Filed: Jul. 3, 2008

(65) Prior Publication Data

US 2009/0021177 A1 Jan. 22, 2009

(30) Foreign Application Priority Data

Jul. 4, 2007 (KR) ..... 10-2007-0066979

(51) Int. Cl.
*H05B 37/02* (2006.01)

(52) U.S. Cl. ..... 315/224; 315/209 R; 315/291; 315/307; 315/308

(58) Field of Classification Search ..... 315/209 R, 315/224–226, 291, 294, 297, 307, 308; 361/90
See application file for complete search history.

(56) References Cited

U.S. PATENT DOCUMENTS 5,699,238 A * 12/1997 Lee et al. ..... 363/21.03
7,298,099 B2 * 11/2007 Ribarich ..... 315/308
7,378,807 B2 * 5/2008 Feldtkeller et al. ..... 315/308
7,432,660 B2 * 10/2008 Blair et al. ..... 315/209 CD
7,486,029 B2 * 2/2009 Lee et al. ..... 315/224

* cited by examiner

*Primary Examiner* — Jacob Y Choi
*Assistant Examiner* — Anthony Arpin
(74) *Attorney, Agent, or Firm* — Sidley Austin LLP

(57) ABSTRACT

The present invention relates to a diagnostic device and a lamp ballast circuit. The lamp ballast circuit includes a first power switch, a second power switch, a lamp driven according to switching operations of the first and second power switches, a controller for controlling the switching operations of the first and second power switches, and a diagnostic device. The diagnostic device senses a voltage waveform applied to the lamp to determine an end of lamp life (EOLL) condition and an over-voltage, senses a filament voltage of the lamp to determine a filament connection state of the lamp, and determines an over-voltage of a voltage applied to the controller.

25 Claims, 7 Drawing Sheets

DIAGNOSIS CIRCUIT APPARATUS AND LAMP BALLAST CIRCUIT USING THE SAME

CROSS-REFERENCE TO RELATED APPLICATION

This application claims priority to and the benefit of Korean Patent Application No. 10-2007-0066979 filed in the Korean Intellectual Property Office on Jul. 4, 2007, the entire contents of which are incorporated herein by reference.

BACKGROUND

1. Field of the Invention

The present invention relates to a diagnostic device for diagnosing a state of a lamp and a lamp ballast circuit by using the diagnostic device.

2. Description of the Related Art

A conventional diagnostic device for diagnosing a state of a lamp is separately formed from that of a lamp driving circuit. In addition, the conventional diagnostic device may not diagnose the lamp at an end of lamp life (EOLL) condition. Further, since respective diagnostic devices may be designed and manufactured according to types of electronic stabilizing devices of the lamp, manufacturing cost may be increased, and additional processes may be performed.

At the end of lamp life (EOLL) condition, when a lamp is compared with a normal lamp, the lamp voltage and current vary asymmetrically and also the filament equivalent resistance increases. When a ballast device is driven in this state, the ballast device supplies a predetermined amount of current to the lamp, and a power loss increases, caused by the filament equivalent resistance increase at the end of lamp life (EOLL) condition. In addition, heat can be generated in a filament according to the increase of resistance, thus raising the temperature of the filament. Further, as time passes in the end of lamp life (EOLL) condition, the temperature of the filament may continuously increase, and therefore plastic elements contacting the filament in the lamp may melt by the increased temperature. In this case, since constituent elements connecting a lamp to another lamp may be loosened, the lamp may be separated from the other lamp.

The above information disclosed in this Background section is only for enhancement of understanding of the background of the invention and therefore it may contain information that does not form the prior art that is already known in this country to a person of ordinary skill in the art.

SUMMARY

Briefly and generally, embodiments include a diagnostic device that may be used for any type of lamp ballast circuit to diagnose an end of lamp life (EOLL) condition and an abnormal state of a lamp, and a lamp ballast circuit using the diagnostic device.

In some embodiments, a lamp ballast circuit for driving a lamp driven according to switching operations of first and second power switches includes a controller and a diagnostic device. The controller controls a switching operation of the first and second power switches. The diagnostic device senses a voltage applied to the lamp to determine an end of lamp life (EOLL) condition of the lamp and an over-voltage applied to the lamp, senses a filament voltage of the lamp to determine a filament connection state of the lamp, and senses an over-voltage of a voltage applied to the controller. The diagnostic device controls the controller such that the switching operation is not performed when sensing the end-stage of the lifespan, the over-voltage applied to the lamp, an abnormal state of the filament connection, and the over-voltage of the voltage.

In this case, the diagnostic device senses a voltage of a node where a terminal of a first capacitor and the filament of the lamp meet to sense a voltage applied to the lamp. Further, the diagnostic device further includes a filament stage determining unit for comparing a first voltage corresponding to a voltage of the filament and a first reference voltage to determine a filament connection state, wherein the filament stage determining unit determines an abnormal state of the filament connection state when the first voltage is greater than the first reference voltage. The diagnostic device further includes an input voltage detector for comparing a second voltage corresponding to a voltage of the voltage applied to the controller and a second reference voltage to determine whether the voltage of the voltage applied to the controller is the over-voltage. In this case, the diagnostic device further includes a protection circuit unit for applying a ground voltage to the controller to stop the operation of the controller when the filament connection stage is abnormal or the voltage of the voltage applied to the controller is the over-voltage. In further detail, the protection circuit unit includes a logic calculating unit and a switch. An output signal of the input voltage detector and an output signal of the filament stage determining unit are input to the logic calculating unit. The switch performs a switching operation of an output signal of the logic calculating unit. The filament stage determining unit outputs an output signal of a first level when the first voltage is greater than the reference voltage, the input voltage detector outputs an output signal of a second level when the input voltage is determined as an over-voltage, the logic calculating unit turns on the switch in response to the output signal of the first or second level, and a ground voltage is applied to the controller through the turned-on switch. In this case, the logic calculating unit performs an OR operation, the first and second levels are high levels, and the switch is an n-channel transistor. The controller is realized in a self-excited oscillation driving method, and the diagnostic device further includes a protection circuit unit for turning off the second power switch when the filament connection state is abnormal, or the voltage of the voltage applied to the controller is the over-voltage.

In some embodiments, a diagnostic device for diagnosing states of a lamp and a controller for controlling the lamp senses a phase of a voltage waveform applied to the lamp, rectifies the voltage waveform, and separates the rectified voltage waveform into a first phase signal and a second phase signal, and includes an end of lamp life (EOLL) condition determining unit, an over-voltage determining unit, a filament stage determining unit, and an input voltage detector. The end of lamp life (EOLL) condition determining unit uses a maximum value of the first phase signal and a maximum value of the second phase signal to determine an end of lamp life (EOLL) condition, the over-voltage determining unit compares the first and second phase signals to a first reference voltage to determine an over-voltage of the lamp, and the filament stage determining unit compares a first voltage corresponding to a filament voltage of the lamp to a second reference voltage to determine a filament connection state. The input voltage detector compares a second voltage corresponding to a voltage of a voltage applied to the controller to a third reference voltage to determine whether the voltage of the voltage applied to the controller is the over-voltage. The diagnostic device further includes a phase detector, a rectifying unit, a phase separating unit, and a level maintaining unit. The rectifying unit rectifies the voltage waveform applied to the lamp. The phase separating unit uses the phase information, separates the rectified voltage waveform according to the phases, and generates the first and second phase signals. The level maintaining unit detects the maximum values of the first and second phase signals, and generates a first signal corresponding to the maximum value of the first phase signal and a second signal corresponding to the maximum value of the second phase signal. The end of lamp life (EOLL) condition determining unit determines the end of lamp life (EOLL) condition when a difference between the first signal and the second signal is greater than a predetermined threshold value. The diagnostic device further includes a protection circuit unit for stopping light emitting of the lamp when determining the end of lamp life (EOLL) condition or determining the over-voltage of the lamp. In further detail, the protection circuit unit includes a first logic calculating unit, a second logic calculating unit, a flip-flop, and a switch. An output signal of the end of lamp life (EOLL) condition determining unit and an output signal of the over-voltage determining unit are applied to the first logic calculating unit. The output signal of the end of lamp life (EOLL) condition determining unit and the output signal of the over-voltage determining unit are applied to the second logic calculating unit. The flip-flop includes a first terminal connected to an output terminal of the first logic calculating unit and a second terminal connected to an output terminal of the second logic calculating unit, outputs a signal of a second level when a signal input to the first terminal is a first level, and outputs a signal of a fourth level when a signal input to the second terminal is a third level. The switch performs a switching operation according to an output signal of the flip-flop. The end of lamp life (EOLL) condition determining unit outputs the output signal of the end of lamp life (EOLL) condition determining unit as a fifth level when determining the end of lamp life (EOLL) condition, outputs the output signal of the over-voltage determining unit as a sixth level when determining the over-voltage of the lamp, and the ground voltage is applied to an output terminal of the protection circuit unit when the switch is turned on. In this case, the first logic calculating unit performs an OR operation, the second logic calculating unit performs a NOR operation, the first, second, third, fifth, and sixth levels are high levels, the fourth level is a low level, and the switch is an n-channel transistor. The diagnostic device may further include a protection circuit unit for interrupting a voltage applied to the lamp when the filament connection stage is abnormal or the voltage of the voltage applied to the controller is the over-voltage. In this case, the protection circuit unit includes a logic calculating unit and a switch. An output signal of the input voltage detector and an output signal of the filament stage determining unit are input to the logic calculating unit. The switch performs a switching operation of an output signal of the logic calculating unit. The logic calculating unit performs an OR operation, the first and second levels are high levels, and the switch is an n-channel transistor.

DETAILED DESCRIPTION

Figure 1:
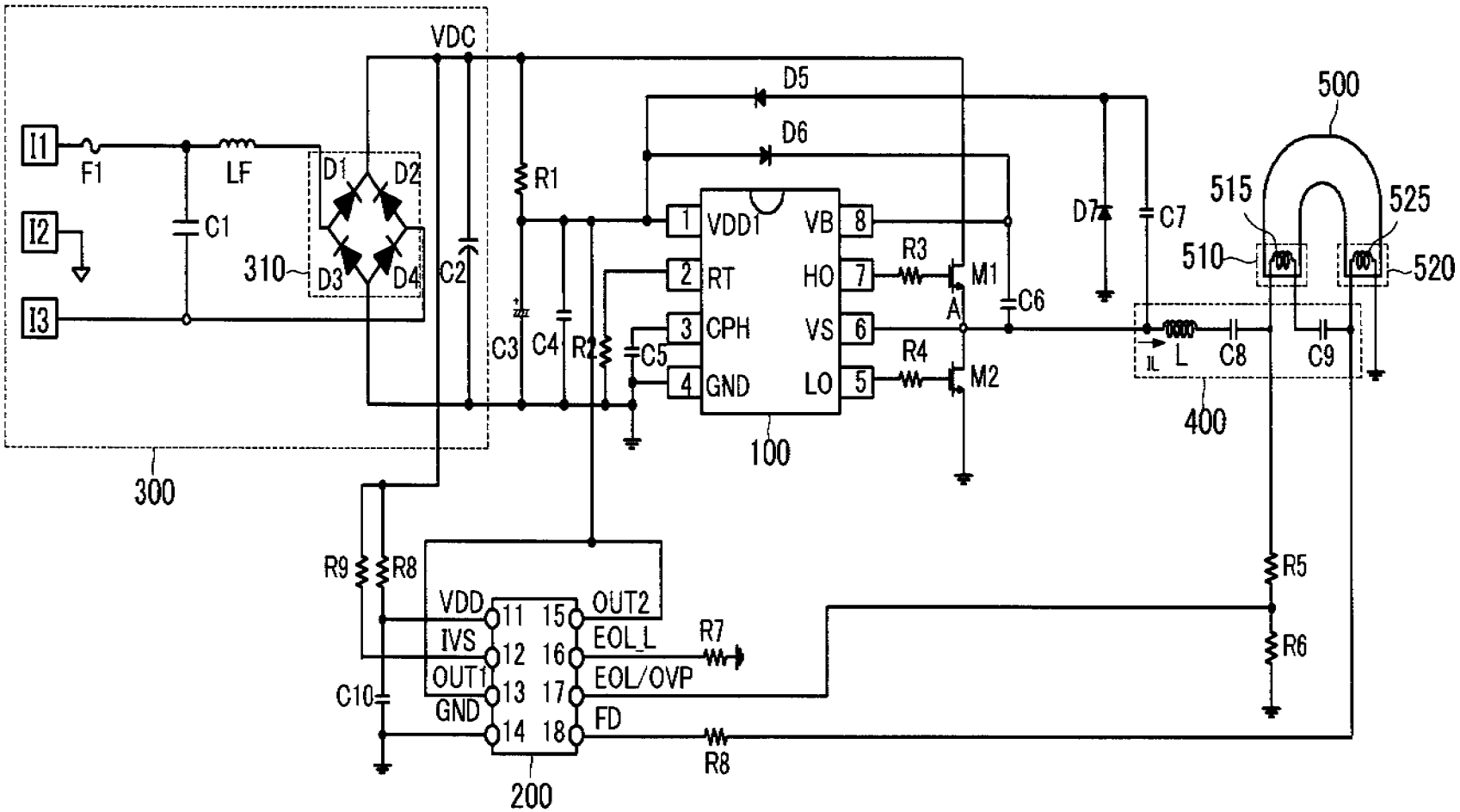
FIG. 1 is a diagram representing a lamp ballast circuit.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element.

A diagnostic device and a lamp ballast circuit using the diagnostic device will now be described with reference to the figures.

FIG. 1 is a diagram representing a lamp ballast circuit. The lamp ballast circuit may include a controller 100, a diagnostic device 200, a power supply 300, and a lamp driver 400.

The power supply 300 can convert an alternating current (AC) voltage input to a terminal I1 and a terminal I3 into a direct current (DC) voltage. Terminal I2 may be grounded. The power supply 300 may include a fuse F1, an inductor LF, a capacitor C1, a bridge diode 310, and a smoothing capacitor C2. The fuse F1 can disrupt the current to protect a lamp ballast when an excessive current flows. The capacitor C1 and the inductor LF can eliminate a noise of the input AC power. The bridge diode 310 can rectify the AC power into the DC power. The smoothing capacitor C2 may eliminate a ripple of the DC power.

The controller 100 can be realized as an integrated circuit (IC) chip including eight pins 1 to 8. In some embodiments the number of pins is eight, but in others it may be different. A cathode of a diode D5 can be connected to a pin 1, and a terminal of a capacitor C7 and a cathode of a diode D7 can be connected to an anode of the diode D5. The diode D7, the diode D5, and the capacitor C7 can generate a voltage VDD1 and supply it to the controller 100.

A resistor R1 can be connected to the power supply 300. In general, a voltage supplied from the power supply 300 can be hundreds of volts, e.g. it can assume 310 V when a 220V AC is used to generate a voltage VDC. Accordingly, pin 1 of the voltage VDD1 of the controller 100 may not be directly connected to the voltage rail, carrying the voltage VDC. Power consumption of the resistor R1 can be generated when the resistor R1 is used to supply a required current to the controller 100. Accordingly, the resistance of the resistor R1 can be selected such that a current of hundreds of uA (micro-Ampers), suitable to drive the controller 100, flows. Upon starting the driving of the controller 100, a voltage VS at a node A may swing between the voltage VDC and a ground voltage GND. Also, a capacitor C3 can be charged through the capacitor C7 while the voltage VS increases from the ground voltage GND to the voltage VDC, thus generating a driving voltage VDD1 of the controller 100. When the voltage Vo decreases from the voltage VDC to the ground voltage GND, the diode D5 prevents the discharging of the capacitor C3. In addition, the diode D7 conducts so that the capacitor C7 is discharged. This method is often referred to as a charge pump method.

The pin 1 can be connected to a terminal of the resistor R1, and the voltage VDD1 can be input to the controller 100 through the pin 1. The voltage VDD1 may supply a voltage to drive the controller 100. A pin 2 can be connected to a resistor R2 operating as an oscillator frequency set resistor. The resistor R2 can control a switching frequency of an upper power switch M1 and a lower power switch M2. The controller 100 may include an oscillator (not shown). A frequency of this oscillator can vary according to a value of the resistor R2.

In general, to efficiently drive a lamp, a method for initially driving the lamp with a high switching frequency and then reducing the switching frequency after a predetermined time passes can be used. The lamp ballast circuit can be driven by the above method. In this case, the controller 100 may use a capacitor C5 to establish a period of a high frequency. A pin 3 of the controller 100 can be connected to the capacitor C5. In a method for establishing the period of the high frequency, a predetermined current can flow to the capacitor C5 to measure a time for reaching a predetermined voltage. In such circuits, the capacitor C5 is used as a timer. Accordingly, when a capacitance of the capacitor C5 is great, the period of the high frequency is high. A pin 4 can be connected to a ground terminal GND. The capacitor C3 may be connected between the voltage VDD1 and the ground terminal GND to maintain the voltage VDD1 and prevent its sudden variations. A pin 8 can be connected to a terminal of a capacitor C6, and can receive a voltage VB of the terminal of the capacitor C6. A pin 6 can be connected to another terminal of the capacitor C6, and receive a voltage VS of the other terminal of the capacitor C6.

A diode D6 having an anode connected to pin 1 and a cathode to a capacitor C6 may use the voltage VDD1 to generate the voltage VB to drive the upper power switch M1. The voltage VB can have a predetermined level relative to the voltage VS. A pin 7 may output a signal HO for controlling the upper power switch M1. The signal HO can swing between the voltage VB and the voltage VS. In addition, a pin 5 can output a signal LO for controlling the lower power switch M2. The signal LO can swing between the voltage VS and the ground voltage GND. The switching operation of the switches M1 and M2 can be controlled according to the signal HO and the signal LO. A terminal of a resistor R3 may be coupled to the pin 7 outputting the signal HO, and another terminal of the resistor R3 to a gate electrode of the upper power switch M1. A terminal of a resistor R4 may be connected to the pin 5 outputting the signal LO, and another terminal of the resistor R4 to a gate electrode of the lower power switch M2. In some embodiments, the upper power switch M1 and the lower power switch M2 are metal-oxide semiconductor field effect transistors (MOSFET), but are not limited thereto. The resistor R3 and the resistor R4 reduce currents supplied to the gate electrodes of the upper power switch M1 and the lower power switch M2. When the upper power switch M1 and the lower power switch M2 conduct according to the signals HO and LO transmitted to the gate electrodes, no more current flows to the gate electrodes.

A drain electrode of the upper power switch M1 can be coupled to the voltage VDC, and a source electrode thereof to a drain electrode of the lower power switch M2 through the node A. A source electrode of the lower power switch M2 can be grounded. The voltage VDC can supply the DC voltage to the drain electrode of the upper power switch M1.

The lamp driver 400 may include an inductor L, a capacitor C8, and a capacitor C9. The voltage Vo can be applied to a terminal of the inductor L. The voltage VS can assume a value close to the voltage VDC when the upper power switch M1 is turned on. The voltage Vo can reach the ground voltage when the lower power switch M2 is turned on. When a lamp 500 is turned on and is stabilized, the voltage Vo can increase to a value close to the voltage VDC before the upper power switch M1 is turned on by a resonant current IL flowing to the inductor L. In addition, the voltage Vo can become a voltage that is close to the ground voltage by the resonant current IL before the lower power switch M2 is turned on. The above switching operation is referred to as a zero-voltage switching operation. The lamp 500 can include two terminals 510 and 520, and the terminals 510 and 520 can respectively include filaments 515 and 525. A first terminal and a second terminal of the capacitor C9 can be respectively connected to the terminals 510 and 520, making the capacitor C9 connected in parallel to the lamp 500. In addition, a first terminal of the capacitor C8 may be connected to the terminal 510, and a second terminal of the inductor L to a second terminal of the capacitor C8. The lamp 500, the inductor L, and the capacitors C8 and C9 form a resonant circuit. The resonant tank is driven according to the switching operations of the upper power switch M1 and the lower power switch M2. Accordingly, the lamp 500 can emit light according to the voltage Vo and the current IL generated according to the switching operations of the upper power switch M1 and the lower power switch M2.

The diagnostic device 200 can be formed as an IC chip including eight pins 11 to 18. A pin 11 may be connected to a node of a first terminal of a resistor R8 and a first terminal of a capacitor C10. Accordingly, a voltage VDD2 that is obtained by low band filtering the voltage VDC is transmitted to the pin 11. A pin 12 can receive the voltage VDC through a resistor R9. A pin 13 may be connected to the pin 1 of the controller 100, and the diagnostic device 200 can transmit a first disorder detection signal OUT1 to the pin 13 when sensing a disorder of the lamp 500. The controller 100 stops operating according to the first disorder detection signal OUT1. At this time, the upper power switch M1 and the lower power switch M2 are interrupted, and the lamp 500 stops emitting the light. A pin 14 is grounded. A pin 18 can be connected to the first terminal of the resistor R8. A second terminal of the resistor R8 can be connected to the first terminal of the capacitor C9 and the filament 525 of the lamp 500. A voltage signal, corresponding to a voltage applied to the filament 525, may be transmitted to the diagnostic device 200 through the pin 18. A pin 17 can be connected to a node between a first terminal of a resistor R5 and a first terminal of a resistor R6. A second terminal of the resistor R5 can be connected to the capacitor C8 and the filament 515. This way, a voltage applied to the lamp 500 is divided according to a resistance ratio of the resistor R5 and the resistor R6 and can be transmitted to the pin 17. The diagnostic device 200 can use a voltage of the pin 17 to determine an end-stage of a lifespan of the lamp 500 and perform over-voltage protection, which will be described later in the description. A pin 16 can be connected to a first terminal of a resistor R7. A second terminal of the resistor R7 is grounded. Since a voltage generated across the resistor R7 is input to the pin 16, the diagnostic device 200 may generate a reference voltage having a predetermined level. The reference voltage may be used to determine the end-stage of the lifespan of the lamp 500. A pin 15 can be connected to the pin 1 of the controller 100. When sensing the end-stage of the lifespan and an over-voltage, the diagnostic device 200 may generate a second disorder detection signal OUT2 and transmits the second disorder detection signal OUT2 to the pin 1 of the controller 100.

Figure 2:
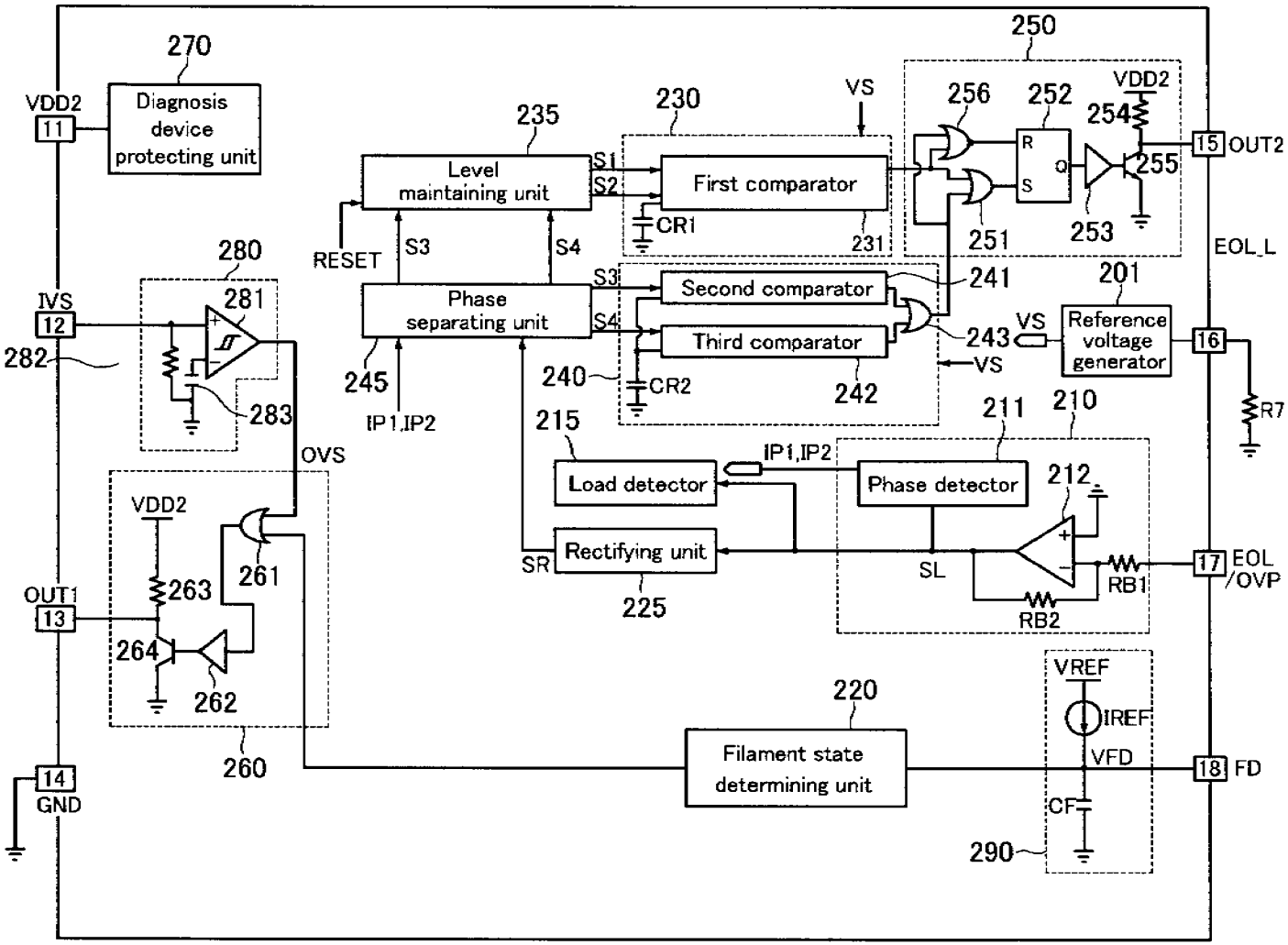
FIG. 2 is a diagram representing a diagnostic device.

FIG. 2 is a diagram representing the diagnostic device 200. The diagnostic device 200 can sense the end-stage of the lifespan and the over-voltage of the lamp 500 and stop the light emitting operation of the lamp 500. A sensing unit 210 can include a phase detector 211, a comparator 212, a resistor RB1, and a resistor RB2. A first terminal of the resistor RB1 can be connected to the pin 17, and a second terminal thereof to an inverting terminal (−) of the comparator 212. A terminal of the resistor RB2 can be connected to the inverting terminal (−) of the comparator 212, and another terminal thereof can be connected to an output terminal of the comparator 212. Accordingly, a voltage input through the pin 17 can be amplified by a gain corresponding to a resistance ratio of RB2 to RB1 to be output from the comparator 212. The phase detector 211 can sense a phase of a signal output from the comparator 212, generate a first phase detection signal IP1 and a second phase detection signal IP2, and transmit these signals to a phase separating unit 245.

Figure 3A:
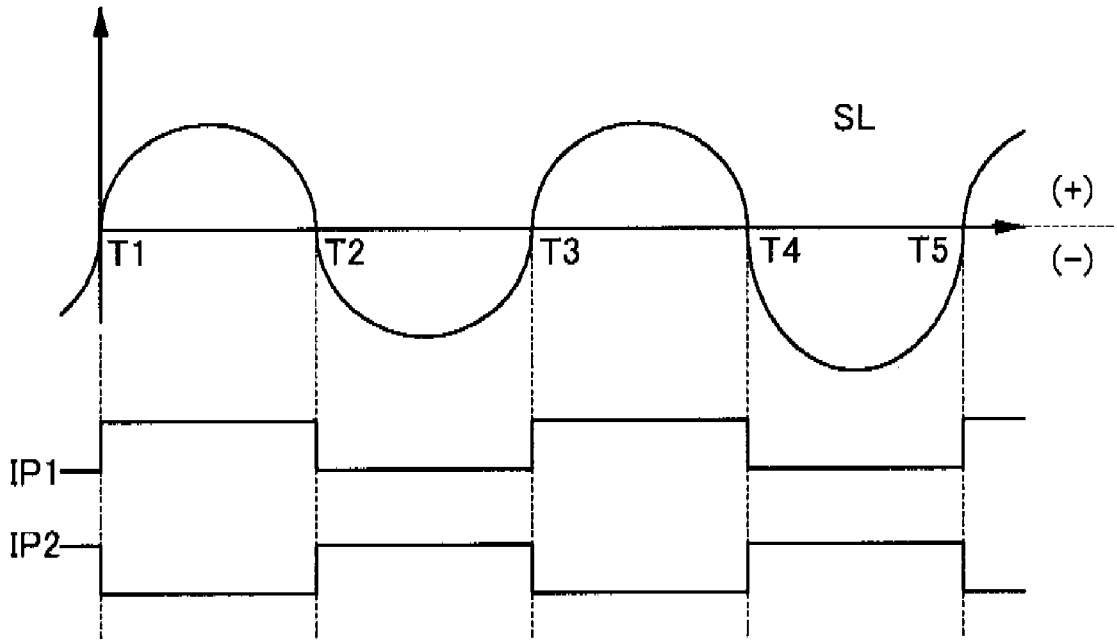
FIG. 3A is a diagram representing a waveform of a signal SL output from a comparator, and a first phase detection signal IP1 and a second phase detection signal IP2.

FIG. 3A is a diagram representing waveforms of a signal SL output from the comparator 212, of the first phase detection signal IP1 and the second phase detection signal IP2.

The phase detector 211 can sense that the signal SL is inverted from a negative phase to a positive phase, or vice versa, and change levels of the first phase detection signal IP1 and the second phase detection signal IP2 in synchronization with a sensing time. Thereby, the first phase detection signal IP1 may become a high level at a time T1 when the signal SL is inverted from the negative phase to the positive phase, and a low level at a time T2 when the signal SL is inverted from the positive phase to the negative phase. The second phase detection signal IP2 may become a high level at the time T2 when the signal SL is inverted from the positive phase to the negative phase, and a low level at a time T3 when the signal SL is inverted from the negative phase to the positive phase. The phase detector 211 can repeatedly perform the above operations, generate the first phase detection signal IP1 and the second phase detection signal IP2, and transmit them to the phase separating unit 245. While the phase detector 211 generates the first and second phase detection signals IP1 and IP2, it is not limited thereto. The phase detector 211 may generate one of the first phase detection signal IP1 and the second phase detection signal IP2.

Figure 3B:
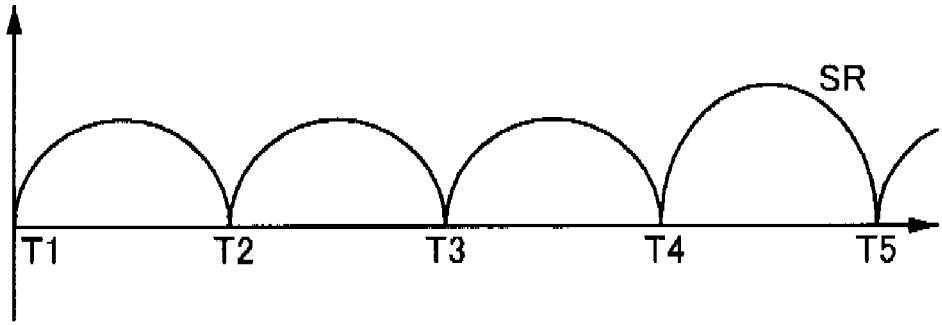
FIG. 3B is a diagram representing a signal SR generated by rectifying the signal SL by a rectifying unit.

A rectifying unit 225 can rectify the signal SL to transmit a rectified signal SR to the phase separating unit 245. FIG. 3B is a diagram representing the signal SR generated by rectifying the signal SL by the rectifying unit 225. As shown in FIG. 3B, the signal SR has positive phases. The signal SL and the signal SR shown in FIG. 3A and FIG. 3B are illustrated as waveforms of the end-stage of the lifespan of the lamp 500. At the end-stage of the lifespan of the lamp 500, a maximum negative phase waveform amplitude and a maximum positive phase waveform amplitude of the signal SL can be asymmetric. A maximum amplitude of the signal having the negative phase in a period of T4 to T5, shown in FIG. 3A and FIG. 3B, can be different from a maximum amplitude of the signal SL of a period within T1 to T4.

A load detector 215 can detect a load connected to the lamp ballast circuit. When there is no lamp connected to the lamp ballast circuit, a voltage of the pin 17 divided by the resistors R5 and R6 can be maintained to be lower than a predetermined voltage, since only the inductor L, the capacitor C8, and the resistors R5 and R6 are connected. The load detector 215 can detect a voltage of the signal SL. When determining that the voltage is lower than the predetermined voltage, the load detector 215 can determine that the lamp is not connected.

The phase separating unit 245 may receive the first phase detection signal IP1, the second phase detection signal IP2, and the signal SR, separate the signal SR into a positive signal S3 and a negative signal S4, and transmit them to an over-voltage determining unit 240 and a level maintaining unit 235.

Figure 3C:
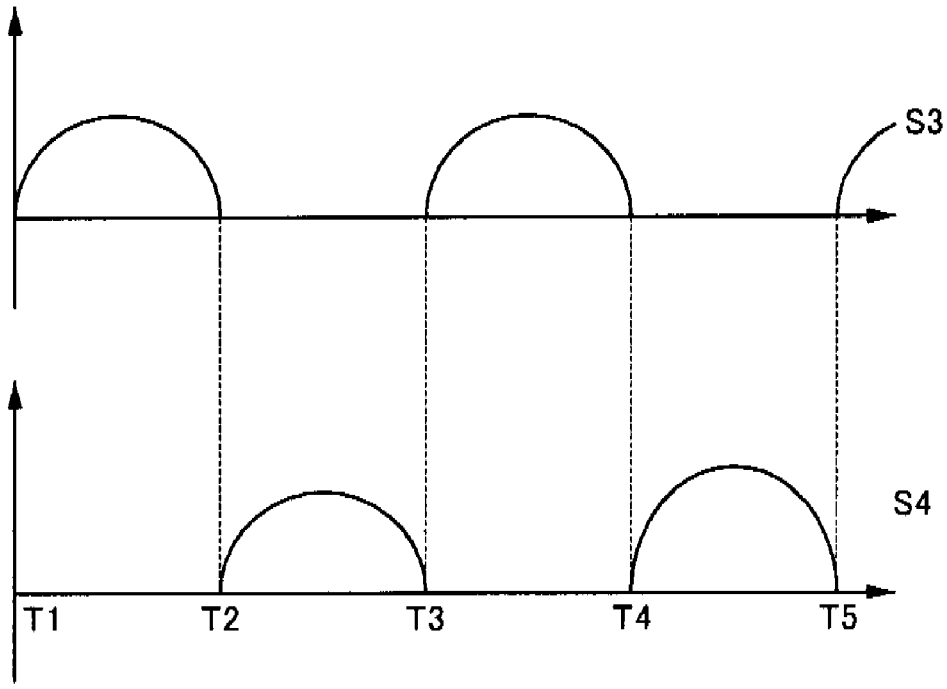
FIG. 3C is a drawing representing positive and negative signals S3 and S4 output from a phase separating unit.

FIG. 3C illustrates the positive and negative signals S3 and S4 output from the phase separating unit 245. The phase separating unit 245 may determine a component of the signal SR corresponding to periods of T1 to T2 and T3 to T4, when the first phase detection signal IP1 is the high level, to be the positive signal S3, and a component of the signal SR corresponding to periods of T2 to T3 and T4 and T5, when the second phase detection signal IP2 is the high level, to be the negative signal S4, in order to separate the signal SR into the positive and negative signals S3 and S4.

The level maintaining unit 235 may detect maximum values of the positive signal S3 and the negative signal S4 and maintain them.

Figure 3D:
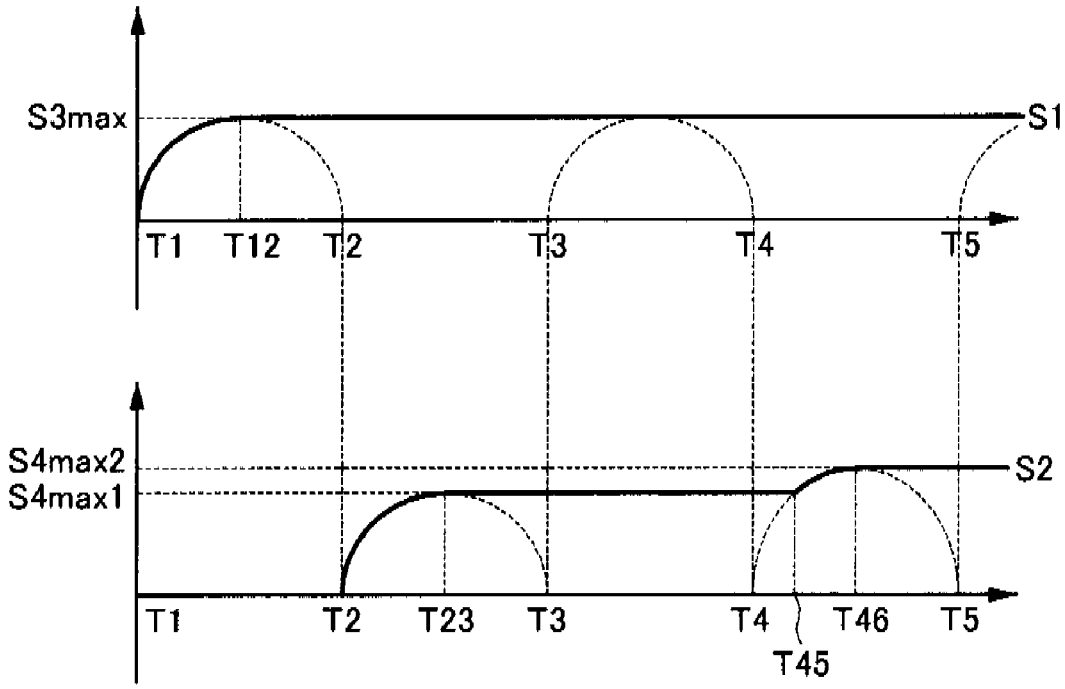
FIG. 3D is a diagram representing signals S1 and S2 generated by detecting maximum values of a positive signal S3 and a negative signal S4 by a level maintaining unit.

FIG. 3D is a diagram representing signals S1 and S2 generated by detecting the maximum values of the positive signal S3 and the negative signal S4 by the level maintaining unit 235. The level maintaining unit 235 can sense a waveform of the positive signal S3, and detect a maximum value of the waveform of the positive signal S3. The level maintaining unit 235 can generate the signal S1 having a level corresponding to the detected maximum value of the waveform of the positive signal S3. During a time T1 through a time T12, as the waveform of the positive signal S3 is increasing to a value S3max, the value of the signal S1 can increase to the value S3max. After time T12, the waveform of the positive signal S3 may not exceed than the value S3max. Then, the value of the signal S1 maintains the value S3max. Since the maximum value of the waveform of the period of T3 to T4 can be the same as the previous value, the level of the signal S1 can be maintained.

Similarly, the level maintaining unit 235 can detect a maximum value of the negative signal S4 and maintain it. That is, the level maintaining unit 235 can generate the signal S2 having a level corresponding to a maximum value of the negative signal S4, S4max1, at a time T23 and maintain the value S4max1. The level maintaining unit 235 can sense that the maximum value of the negative signal S4 is changed from the value S4max1 to a value S4max2 that is higher than the maximum value S4max1 during a time T45 through a time T46, change the level of the signal S2 to a level corresponding to the maximum value of the negative signal S4, and maintain S4max2. The signals S1 and S2 may be voltage signals, but are not limited thereto.

Referring back to FIG. 2, a reference voltage generator 201 can include a current source (not shown) and generate the reference voltage VS when a current of the current source flows through the resistor R7. The reference voltage VS can be transmitted to an end-stage determining unit 230 and the over-voltage determining unit 240.

The end-stage determining unit 230 may include a first comparator 231 and a capacitor CR1 storing a first reference voltage Vref1. The capacitor CR1 can partially store the reference voltage VS transmitted from the reference voltage generator 201, and in this case, a voltage stored in the capacitor CR1 is the first reference voltage Vref1. The first comparator 231 can compare a difference between the levels of the signals S1 and S2 to the first reference voltage Vref1, and determine that the lamp 500 is in its end-stage when the absolute value of the difference between the levels of the signals S1 and S2 is greater than the first reference voltage Vref1. When determining that the lamp 500 is in its end-stage, the end-stage determining unit 230 can generate a signal S5 of a high level, and transmit it to a second protection circuit unit 250.

The over-voltage determining unit 240 may include a second comparator 241, a third comparator 242, an OR gate 243, and a capacitor CR2, storing a second reference voltage Vref2. The capacitor CR2 can partially store the reference voltage VS transmitted from the reference voltage generator 201. A voltage stored in the capacitor CR2 can be the second reference voltage Vref2. The second comparator 241 can compare the positive signal S3 to the second reference voltage Vref2, and transmit a high level signal to the OR gate 243 when the positive signal S3 is greater than the second reference voltage Vref2. The third comparator 242 may compare the negative signal S4 to the second reference voltage Vref2 and transmit a high level signal to the OR gate 243 when the negative signal S4 is greater than the second reference voltage Vref2. The OR gate 243 may generate a signal S6 of a high level when one of the signals output from the second comparator 241 and the third comparator 242 is a high level, and transmit it to the second protection circuit unit 250. When one of the positive signal S3 and the negative signal S4 is greater than the second reference voltage Vref2, the over-voltage determining unit 240 can determine the occurrence of an over-voltage.

The second protection circuit unit 250 may stop an operation of the controller 100 when determining the over-voltage and the end-stage of the lifespan. The second protection circuit unit 250 may include an OR gate 251, an SR flip-flop 252, a driver 253, a resistor 254, a switch 255, and a NOR gate 256. The switch 255 can be an n-channel type bipolar junction transistor, but it is not limited thereto. The OR gate 251 can output a high level to a set terminal S of the SR flip-flop 252 when one of the signal S5 and the signal S6 is a high level. The SR flip-flop 252 may output the signal of a high level through an output terminal Q when receiving the high level signal through the set terminal S. The driver 253 can output a signal having a level for sufficiently turning on the switch 255 according to the high level signal output from the output terminal Q. Thereby, the switch 255 is turned on and the diagnostic device 200 outputs a second disorder detection signal OUT2 having a ground voltage level to the pin 15. While the switch 255 is turned off, a voltage that is the same as the voltage of the voltage VDD1 can be output to the pin 15. The voltage VDD2 and the resistor 254 can be appropriately established such that a voltage that is the same as the voltage of the voltage VDD1 may be output to the pin 15. The NOR gate 256 may generate a reset signal RESET when the signal S5 and the signal S6 become low levels, and transmit the reset signal RESET to a reset terminal of the SR flip-flop 252.

A filament voltage generator 290 can include a current source IREF, a voltage source VREF, and a capacitor CF. The voltage source VREF can generate the current source IREF. A voltage charged in the capacitor CF may vary according to a connection state between the filaments 515 and 525 of the lamp 500 that are connected to the pin 18 and the lamp ballast circuit. When the filament 515 is connected between the capacitor C8 and the capacitor C9 of the lamp driver 400 of the lamp ballast circuit and the filament 525 is connected between the capacitor C9 and the ground terminal, resistance of the filaments 515 and 525 can be low. Resistances connected to the pin 18 include the resistor R8 and resistances of the filament 515 and the filament 525. If only the filaments 515 and 525 are connected with the resistor R8, the current source IREF may not be required to be a high current source to maintain the pin 18 at a predetermined voltage. However, since current capacity of the current source IREF is limited, it is required to provide the resistor R8 to maintain a stable voltage VFD.

A filament state determining unit 220 can detect a level of the voltage VFD, and determine a state of the filament according to the voltage VFD. The filament state determining unit 220 may establish a first state reference voltage having a predetermined potential, compare the voltage VFD and the first state reference voltage, and determine a connection state between the filaments 515 and 525 and the lamp ballast circuit. When the voltage VFD is lower than the first state reference voltage, the connection state of the filaments 515 and 525 can be normal. When the voltage VFD is higher than the first state reference voltage, the connection state of the filaments 515 and 525 can be abnormal. The filament state determining unit 220 may transmit a signal FSD to a first protection circuit unit 260. If the lamp ballast circuit is connected to two lamps and the filament connection state of two lamps is abnormal, the voltage VFD can be higher than that when the filament connection state of one lamp is abnormal. In this case, the filament state determining unit 220 can use a second state reference voltage that is higher than the first state reference voltage to determine that the filament connection state of the two lamps is abnormal.

In further detail, the filament state determining unit 220 may determine that the filament connection state of one lamp is abnormal when the voltage VFD is higher than the first state reference voltage and is lower than the second state reference voltage. When the voltage VFD is higher than the second state reference voltage, the filament state determining unit 220 may determine that the filament connection states of the two lamps are abnormal. The filament state determining unit 220 can transmit the high level signal to the first protection circuit unit 260 when the filament connection state of one of the two lamps is abnormal.

An input voltage detector 280 can prevent the controller from being damaged by the over-voltage of the voltage VDC supplied to the controller 100. The voltage of the voltage VDC can be divided by a resistance ratio of a resistor 282 and the resistor R9, connected to the pin 12 to be input to a non-inverting terminal (+) of a comparator 281. The comparator 281 can compare a voltage charged in a capacitor 283 connected to its inverting terminal (−) and a voltage input to its non-inverting terminal (+). When a voltage obtained by dividing the voltage input to the non-inverting terminal (+) is higher than the voltage charged in the capacitor 283, the comparator 281 can output a signal OVS of a high level to the first protection circuit unit 260. The voltage charged in the capacitor 283 can be a type of threshold value, and it is established to protect the controller 100 when the voltage VDC reaches a level that may deteriorate the controller 100.

A diagnostic device protecting unit 270 can control the diagnostic device 200 such that the diagnostic device 200 does not start to operate before the voltage of the voltage VDD2 reaches a bias voltage level required to appropriately drive the diagnostic device 200.

The first protection circuit unit 260 can stop the operation of the controller when the voltage of the voltage VDC input to the controller 100 is the over-voltage, the filament connection is abnormal, or there is no lamp connected to the lamp ballast circuit, so as to stop the lamp 500 from emitting light. The first protection circuit unit 260 can include an OR gate 261, a driver 262, a switch 264, and a resistor 263. When one among a detection signal OLS, the signal OVS, and the signal FSD input to the OR gate 261 is a high level, the OR gate 261 can transmit the high level signal to the driver 262. The driver 262 can transmit a signal for turning on the switch 264 according to the input high level signal to the switch 264. The switch 264 can be an n-channel bipolar junction transistor. Accordingly, a signal level for turning on the switch 264 is a high level. When the switch 264 is turned on, a ground voltage can be applied to the pin 1 of the controller 100, the controller 100 may stop the operation, and the upper and lower power switches M1 and M2 do not perform the switching operation. Thereby, the flow of energy transmitted to the lamp driver 400 is interrupted, and therefore the lamp 500 does not emit light. While the switch 264 is turned off, there is no current flowing through the resistor 263. A voltage of a node connected the resistor and the switch 264 is the voltage VDD2. The voltage of the voltage VDD2 may be the same as the voltage VDD1 such that a voltage transmitted to the pin 1 of the controller 100 is the same as the voltage VDD1.

As described, the diagnostic device 200 and the lamp ballast circuit using the diagnostic device may determine the end of lamp life (EOLL) condition of the lamp, the over-voltage of the lamp, the over-voltage of the voltage input to the controller for controlling the lamp ballast circuit, and the filament connection state.

Hereinafter, the diagnostic device 200 in a lamp ballast circuit referred to as a self-excited oscillation driving method will be described. In addition, the lamp ballast circuit comprising the controller 100 realized as an IC chip in the first exemplary embodiment of the present invention is referred to as a forced-excited oscillation driving method.

Figure 4:
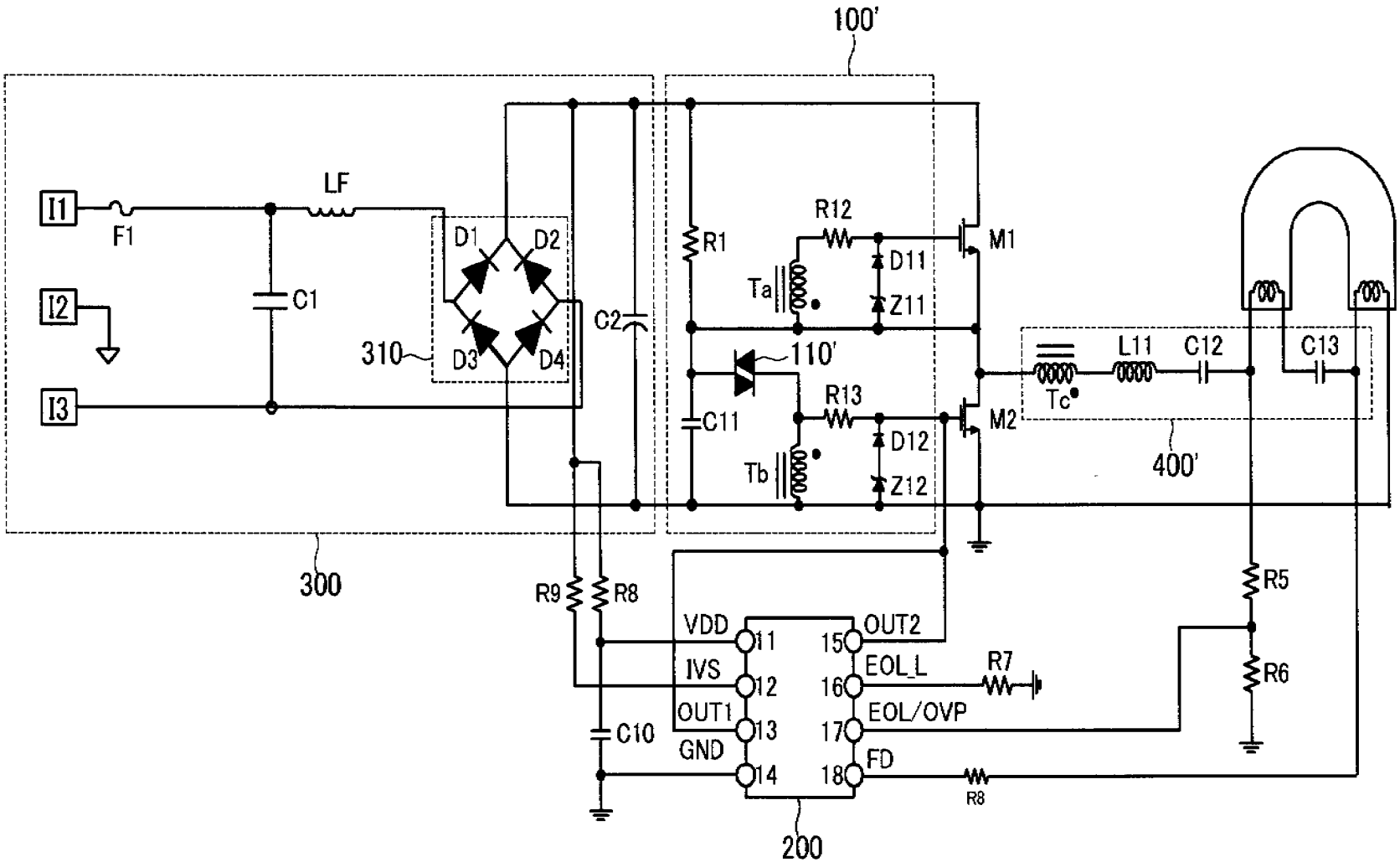
FIG. 4 is diagram representing a lamp ballast circuit using a diagnostic device.

FIG. 4 is a diagram representing a lamp ballast circuit using a diagnostic device. Rather than realizing the controller 100 as an IC chip, as in the first embodiment, the lamp ballast circuit in the present embodiment can use a diac (diode for alternating current) 110', transformers Ta, Tb, and Tc, diodes D11 and D12, and Zener diodes Z11 and Z12 to control the switching operations of the upper and lower power switches M1 and M2. However, the diagnostic device 200 of this embodiment can have the same configuration as that of the diagnostic device 200 of the first embodiment. In particular, the present embodiment can have similar connections between a controller 100' and the respective pins of the diagnostic device 200. The connections of the diagnostic device 200 to the power supply 300, the controller 100', and a lamp driver 400' can be the same as those in the first embodiment except that the pin 13 and the pin 18 may be connected to the gate electrode of the lower power switch M2.

An operation of the lamp ballast circuit of the second embodiment will be described with reference to FIGS. 5A and 5B.

Figure 5A:
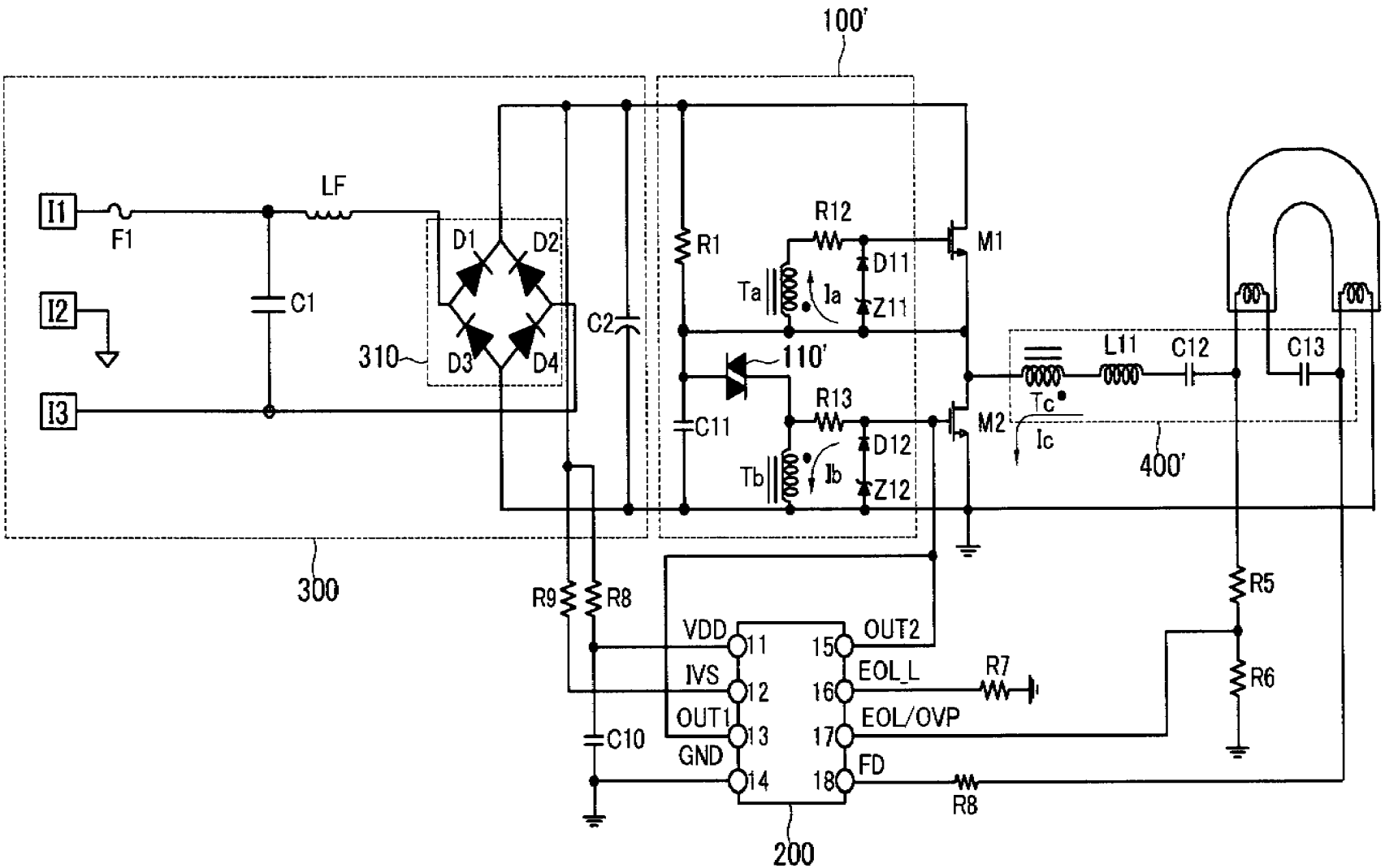
FIG. 5A is a diagram representing an operation when a voltage is applied to a lamp ballast circuit.

FIG. 5A is a diagram representing an operation when a voltage is applied to the lamp ballast circuit. FIG. 5B is a diagram representing an operation after the operation shown in FIG. 5A. A coil Ta and a coil Tb may generate predetermined voltages for respectively driving the upper power switch M1 and the lower power switch M2. In addition, a coil Tc can sense a current transmitted from the controller 100' to the lamp driver 400'.

When a voltage is applied from the power supply 300 to the controller 100', a voltage of a capacitor C11 may slowly increase. When the voltage of the capacitor C11 increases and the diac 110' is biased, the lower power switch M2 can be turned on by a voltage induced to the coil Tb. Thereby, a current Ic flowing through the coil Tc can slowly increase, a current Ib flowing through the coil Tb in a direction shown in FIG. 5A decrease, and a current Ia flowing through the coil Ta in a direction shown in FIG. 5A increase. While the current Ib flowing through the coil Tb decreases, the lower power switch M2 is turned off, and the upper power switch M1 is turned on by the increasing current Ia.

Figure 5B:
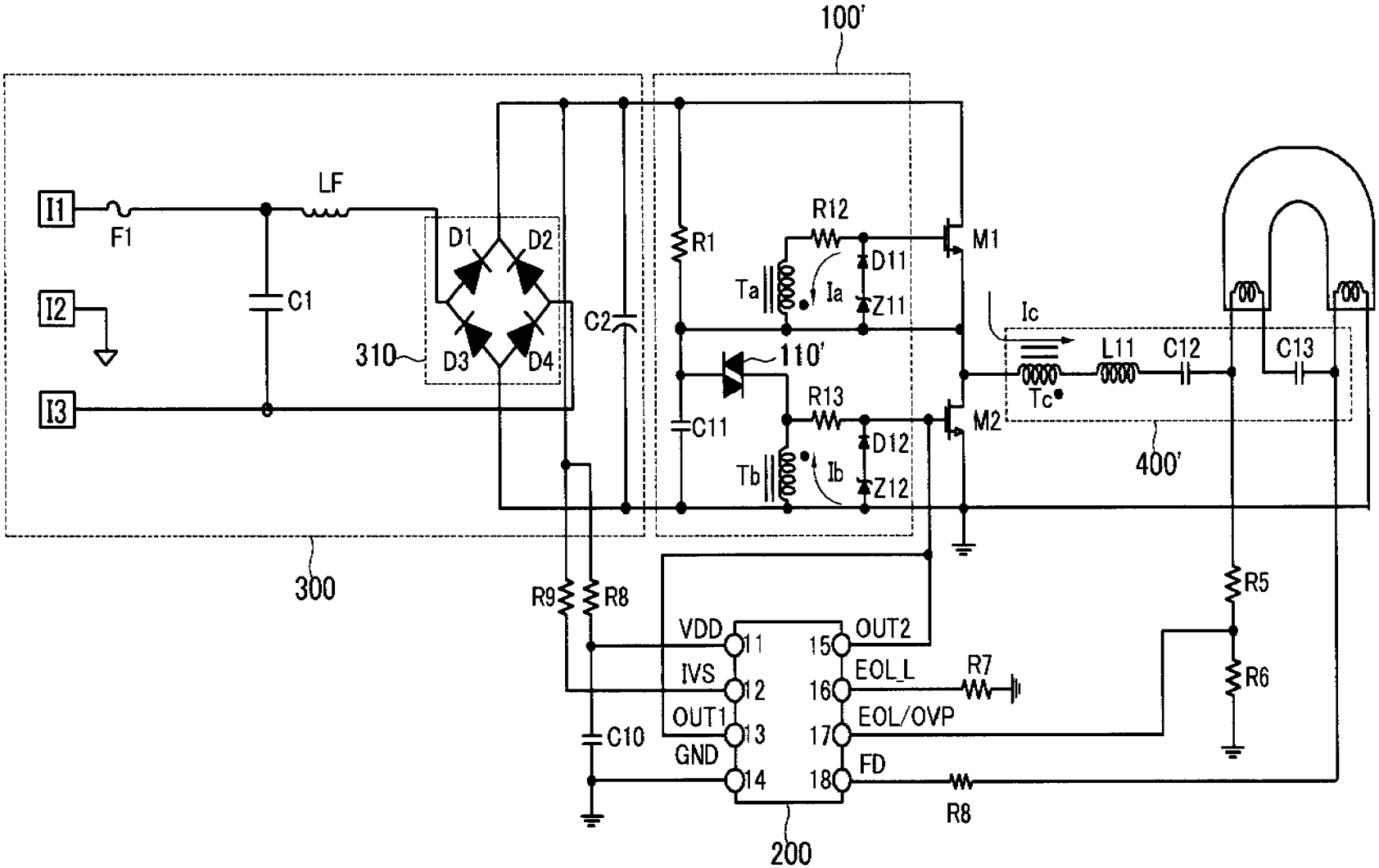
FIG. 5B is a diagram representing an operation after the operation shown in FIG. 5A.

Thereby, directions of the currents Ia, Ib, and Ic can change as shown in FIG. 5B. When the upper power switch M1 is turned on, the current Ic increases. When the current Ic increases, the current Ia flowing in a direction shown in FIG. 5B decreases, and the current Ib flowing in a direction shown in FIG. 5B. The upper power switch M1 is turned on by the decreasing current Ia, and the lower power switch M1 is turned on by the increasing current Ib. The above operations are repeatedly performed.

As described, the diagnostic device 200 may have the same configuration as that of the first embodiment. However, output signals of the first protection circuit unit 260 shown in FIG. 2 and the second protection circuit unit 250 shown in FIG. 2 can be transmitted to the gate electrode of the lower power switch M2. In a like manner of the first embodiment, the first protection circuit unit 260 can apply the ground voltage to the gate electrode of the lower power switch M2 according to the end-stage of the lifespan of the lamp and the over-voltage, and the second protection circuit unit 250 applies the ground voltage to the gate electrode of the lower power switch M2 according to the over-voltage of the voltage input to the controller 100' for controlling the ballast circuit and the abnormal state of the filament connection. Thereby, since the lower power switch M2 is turned off, operations shown in FIG. 5A and FIG. 5B may not be performed. The controller 100' of the second embodiment may start to operate when the diac 110' is biased, and the lower power switch M2 is turned off to interrupt the operation of the controller 100'.

As described earlier, the diagnostic device 200 of the second embodiment may be used in the self-excited method. In addition, in a like manner of the first embodiment, the diagnostic device 200 according to the second embodiment and the lamp ballast circuit using the diagnostic device 200 may determine the end of lamp life (EOLL) condition of the lamp, the over-voltage of the lamp, the over-voltage of the voltage input to the controller for controlling the lamp ballast circuit, and the abnormal state of the filament connection state.

While this invention has been described in connection with what is presently considered to be practical embodiments, it is to be understood that the invention is not limited to the disclosed embodiments, but, on the contrary, is intended to cover various modifications and equivalent arrangements included within the spirit and scope of the appended claims.

What is claimed is:

1. A lamp ballast circuit for driving a lamp driven according to switching operations of first and second power switches, the lamp ballast circuit comprising:

a controller configured to control a switching operation of the first and second power switches; and a diagnostic device configured to sense a voltage applied to the lamp, to sense a phase of a voltage waveform applied to the lamp, to rectify the voltage waveform, to separate the rectified voltage waveform into first and second phase signals, and to use proportional values of the first and second phase signals to determine an end of lamp life (EOLL) condition, and to control the controller such that the switching operation is not performed when the end of lamp life (EOLL) condition occurs.

2. The lamp ballast circuit of claim 1, wherein the diagnostic device comprises:

a detector configured to sense the phase of the voltage waveform applied to the lamp to generate phase information;

a rectifying unit configured to rectify the voltage waveform applied to the lamp;

a phase separating unit configured to use the phase information, to separate the rectified voltage waveform according to phases, and to generate the first and second phase signals;

a level maintaining unit configured to detect the values of the first and second phase signals, and to generate a first signal corresponding to the value of the first phase signal and a second signal corresponding the value of the second phase signal; and an end of lamp life (EOLL) condition determining unit configured to determine the end of lamp life (EOLL) condition when a difference between the first signal and the second signal is greater than a predetermined threshold value.

3. The lamp ballast circuit of claim 2, wherein the end of lamp life (EOLL) condition determining unit is configured to compare an absolute value of the difference between the first signal and the second signal to a reference voltage, and to determine the end of lamp life (EOLL) condition when the absolute value of the difference between the first and second signals is greater than the reference voltage.

4. The lamp ballast circuit of claim 1, wherein the diagnostic device further comprises an over-voltage determining unit configured to compare the first and second phase signals to a first reference voltage, and to determine an over-voltage.

5. The lamp ballast circuit of claim 4, wherein the diagnostic device further comprises a protection circuit unit configured to apply a ground voltage to the controller to stop an operation of the controller when determining the end of lamp life (EOLL) condition or determining the over-voltage of the lamp.

6. The lamp ballast circuit of claim 5, wherein the protection circuit unit comprises:

a first logic unit to which an output signal of the end of lamp life (EOLL) condition determining unit and an output signal of the over-voltage determining unit are applied;

a second logic unit to which the output signal of the end of lamp life (EOLL) condition determining unit and the output signal of the over-voltage determining unit are applied;

a flip-flop that includes a first terminal connected to an output terminal of the first logic unit and a second terminal connected to an output terminal of the second logic unit, that outputs a signal of a second level when a signal input to the first terminal is a first level, and that outputs a signal of a fourth level when a signal input to the second terminal is a third level; and a switch configured to perform a switching operation according to an output signal of the flip-flop, wherein the end of lamp life (EOLL) condition determining unit is configured to output the output signal of the end of lamp life (EOLL) condition determining unit as a fifth level when determining the end of lamp life (EOLL) condition and to output the output signal of the over-voltage determining unit as a sixth level when determining the over-voltage of the lamp, and the ground voltage is applied to an output terminal of the protection circuit unit when the switch is turned on.

7. The lamp ballast circuit of claim 6, wherein the first logic unit is configured to perform an OR operation, the second logic unit is configured to perform a NOR operation, the first, second, third, fifth, and sixth levels are high levels, the fourth level is a low level, and the switch is an n-channel transistor.

8. The lamp ballast circuit of claim 4, wherein the controller is configured to carry out a self-excited oscillation driving method, and the diagnostic device further comprises a protection unit configured to turn off the second power switch when determining the end of lamp life (EOLL) condition or determining the over-voltage of the lamp.

9. The lamp ballast circuit of claim 1, further comprising a lamp driver, configured to drive the lamp to emit light according to a voltage generated according to the switching operation, wherein the lamp driver comprises an inductor, a first capacitor, and a second capacitor, a terminal of the inductor is connected to a node where the first power switch and the second power switch are electrically connected, a terminal of the first capacitor is connected to another terminal of the inductor, a terminal of the second capacitor is electrically connected to another terminal of the first capacitor through a filament of the lamp, and another filament of the lamp is connected to another terminal of the second capacitor.

10. The lamp ballast circuit of claim 9, wherein the diagnostic device is configured to sense a voltage of a node where the other terminal of the first capacitor and the filament of the lamp meet to sense a voltage applied to the lamp.

11. The lamp ballast circuit of claim 1, wherein the diagnostic device further comprises a filament stage determining unit configured to compare a first voltage corresponding to a voltage of a filament of the lamp and a first reference voltage to determine a filament connection state, wherein the filament stage determining unit is configured to determine an abnormal state of the filament connection state when the first voltage is greater than the first reference voltage.

12. The lamp ballast circuit of claim 11, wherein the diagnostic device further comprises an input voltage detector configured to compare a second voltage corresponding to a voltage of the voltage applied to the controller and a second reference voltage to determine whether the voltage of the voltage applied to the controller is the over-voltage.

13. The lamp ballast circuit of claim 12, wherein the diagnostic device further comprises a protection circuit unit configured to apply a ground voltage to the controller to stop the operation of the controller when the filament connection state is abnormal or the voltage of the voltage applied to the controller is the over-voltage.

14. The lamp ballast circuit of claim 13, wherein the protection circuit unit comprises:

a logic unit to which an output signal of the input voltage detector and an output signal of the filament stage determining unit are input; and a switch, configured to perform a switching operation of an output signal of the logic calculating unit, wherein the filament stage determining unit is configured to output an output signal of a first level when the first voltage is greater than the reference voltage, the input voltage detector is configured to output an output signal of a second level when the input voltage is determined as an over-voltage, the logic unit is configured to turn on the switch in response to the output signal of the first or second level, and a ground voltage is coupled to the controller through the turned-on switch.

15. The lamp ballast circuit of claim 14, wherein the logic unit is configured to perform an OR operation, the first and second levels are high levels, and the switch is an n-channel transistor.

16. The lamp ballast circuit of claim 12, wherein the controller is configured to operate in a self-excited oscillation driving method and the diagnostic device further comprises a protection circuit unit configured to turn off the second power switch when the filament connection state is abnormal, or the voltage of the voltage applied to the controller is the over-voltage.

17. The lamp ballast circuit of claim 11, further comprising a lamp driver for driving the lamp to emit light according to a voltage generated according to the switching operation, the lamp driver comprising:

an inductor, a first capacitor, and a second capacitor, a terminal of the inductor being connected to a node where the first power switch and the second power switch are electrically connected, a terminal of the first capacitor being connected to another terminal of the inductor, a terminal of the second capacitor being electrically connected to another terminal of the first capacitor through a filament of the lamp, another terminal of the second capacitor being connected to another filament of the lamp, and the first voltage being a voltage of a node where the other terminal of the second capacitor and the other filament of the lamp are electrically connected.

18. A diagnostic device for diagnosing states of a lamp and a controller configured to control the lamp, the diagnostic device configured to sense a phase of a voltage waveform applied to the lamp, to rectify the voltage waveform, to separate the rectified voltage waveform into a first phase signal and a second phase signal, the diagnostic device comprising:

an end of lamp life (EOLL) condition determining unit configured to use a proportional value of the first phase signal and a proportional value of the second phase signal to determine the end of lamp life (EOLL) condition;

an over-voltage determining unit configured to compare the first and second phase signals to a first reference voltage to determine an over-voltage of the lamp;

a filament stage determining unit configured to compare a first voltage corresponding to a filament voltage of the lamp to a second reference voltage to determine a filament connection state; and an input voltage detector configured to compare a second voltage corresponding to a voltage of a voltage applied to the controller to a third reference voltage to determine whether the voltage of the voltage applied to the controller is the over-voltage.

19. The diagnostic device of claim 18, wherein the diagnostic device further comprises:

a phase detector configured to detect a phase of a voltage waveform applied to the lamp to generate phase information;

a rectifying unit configured to rectify the voltage waveform applied to the lamp;

a phase separating unit configured to use the phase information, to separate the rectified voltage waveform according to the phases, and to generate the first and second phase signals; and a level maintaining unit configured to detect the maximum values of the first and second phase signals, and to generate a first signal corresponding to the maximum value of the first phase signal and a second signal corresponding the maximum value of the second phase signal, wherein the lifespan end-stage determining unit is configured to determine the end-stage of the lifespan of the lamp when a difference between the first signal and the second signal is greater than a predetermined threshold value.

20. The diagnostic device of claim 19, further comprising a protection circuit unit configured to stop a light emission of the lamp when determining the end-stage of the lifespan of the lamp or determining the over-voltage of the lamp.

21. The diagnostic device of claim 20, wherein the protection circuit unit comprises:

a first logic unit to which an output signal of the lifespan end-stage determining unit and an output signal of the over-voltage determining unit are applied;

a second logic unit to which the output signal of the lifespan end-stage determining unit and the output signal of the over-voltage determining unit are applied;

a flip-flop that includes a first terminal connected to an output terminal of the first logic calculating unit and a second terminal connected to an output terminal of the second logic calculating unit, outputs a signal of a second level when a signal input to the first terminal is a first level, and outputs a signal of a fourth level when a signal input to the second terminal is a third level; and a switch configured to perform a switching operation according to an output signal of the flip-flop, wherein the lifespan end-stage determining unit is configured to output the output signal of the lifespan end-stage determining unit as a fifth level when determining the end of lamp life (EOLL) condition and to output the output signal of the over-voltage determining unit as a sixth level when determining the over-voltage of the lamp, and the ground voltage is applied to an output terminal of the protection circuit unit when the switch is turned on.

22. The diagnostic device of claim 21, wherein the first logic unit is configured to perform an OR operation, the second logic unit is configured to perform a NOR operation, the first, second, third, fifth, and sixth levels are high levels, the fourth level is a low level, and the switch is an n-channel transistor.

23. The diagnostic device of claim 18, further comprising a protection circuit unit configured to interrupt a voltage applied to the lamp when the filament connection stage is abnormal or the voltage of the voltage applied to the controller is the over-voltage.

24. The diagnostic device of claim 23, wherein the protection circuit unit comprises:

a logic unit to which an output signal of the input voltage detector and an output signal of the filament stage determining unit are input; and a switch configured to perform a switching operation of an output signal of the logic calculating unit, wherein the filament stage determining unit is configured to output an output signal of a first level when the first voltage is greater than the second reference voltage, the input voltage detector is configured to output an output signal of a second level when the second voltage is greater than the third reference voltage, the logic unit is configured to turn on the switch according to the first level or the second level, and a ground voltage is applied to the controller when the switch is turned on.

25. The diagnostic device of claim 24, wherein the logic unit is configured to perform an OR operation, the first and second levels are high levels, and the switch is an n-channel transistor.

* * * * *